US009742101B2

(12) United States Patent
Nakata et al.

(10) Patent No.: US 9,742,101 B2
(45) Date of Patent: Aug. 22, 2017

(54) CRIMP TERMINAL

(71) Applicant: Yazaki Corporation, Tokyo (JP)

(72) Inventors: Hirohito Nakata, Shizuoka (JP); Kazuhide Takahashi, Shizuoka (JP); Takato Yoshida, Shizuoka (JP); Hiroshi Kobayashi, Okazaki (JP); Hiroyasu Taga, Toyota (JP); Motoya Hara, Nisshin (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/379,785

(22) Filed: Dec. 15, 2016

(65) Prior Publication Data

US 2017/0179637 A1 Jun. 22, 2017

(30) Foreign Application Priority Data

Dec. 16, 2015 (JP) ..... 2015-244885

(51) Int. Cl.
*H01R 4/10* (2006.01)
*H01R 13/52* (2006.01)
*H01R 4/18* (2006.01)

(52) U.S. Cl.
CPC ..... *H01R 13/5216* (2013.01); *H01R 4/185* (2013.01); *H01R 4/188* (2013.01)

(58) Field of Classification Search
CPC ..... H01R 13/5216; H01R 4/188; H01R 4/185
USPC ..... 439/877
See application file for complete search history.

(56) References Cited

U.S. PATENT DOCUMENTS 4,923,416 A * 5/1990 Zinn ..... H01R 13/052 439/877
2015/0357722 A1 12/2015 Sato
2016/0006164 A1 1/2016 Sato

FOREIGN PATENT DOCUMENTS

JP 2012-069449 A 4/2012
JP 2014-160591 A 9/2014
JP 2014-182957 A 9/2014
JP 2014-182958 A 9/2014

* cited by examiner

*Primary Examiner* — Javaid Nasri
(74) *Attorney, Agent, or Firm* — Sughrue Mion, PLLC

(57) ABSTRACT

A crimp terminal includes a terminal connecting portion and an electric wire connecting portion. The electric wire connecting portion is sectioned into a bottom portion, a first barrel piece, and a second barrel piece, and is sectioned into a core wire crimp portion, a sheath crimp portion, and a coupling crimp portion. A water stop member affixed to the inner wall face of the electric wire connecting portion before crimping processing forms a first water stop area, that suppresses the entry of water, from the gap between the outer wall face of the first barrel piece and the inner wall face of the second barrel piece, a second water stop area from the terminal connecting portion side of the distal end position of a core wire, and a third water stop area from the gap between the inner wall face of the sheath crimp portion and a sheath.

3 Claims, 9 Drawing Sheets

CRIMP TERMINAL

CROSS-REFERENCE TO RELATED APPLICATION(S)

The present application claims priority to and incorporates by reference the entire contents of Japanese Patent Application No. 2015-244885 filed in Japan on Dec. 16, 2015.

BACKGROUND OF THE INVENTION

1. Field of the Invention

The present invention relates to a crimp terminal.

2. Description of the Related Art

Conventionally, a crimp terminal including an electric wire connecting portion to be electrically connected to a core wire of an electric wire is known. This crimp terminal and the electric wire are crimped by a terminal crimping device to be electrically connected to each other. This kind of crimp terminal is required to suppress an entry of water to a gap between the electric wire connecting portion and the core wire of the electric wire. The technique of Japanese Patent Application Laid-open No. 2014-182957 and Japanese Patent Application Laid-open No. 2014-182958 provides a water stop portion that seals the gap between a barrel piece and an electric wire, for example. The water stop portion is formed by affixing a water stop sheet formed of a material such as butyl rubber to the inner surface of the barrel piece and swaging the electric wire set on the water stop sheet with the barrel piece. The technique of Japanese Patent Application Laid-open No. 2014-160591 and Japanese Patent Application Laid-open No. 2012-69449 forms an insulating resin layer (an insulating coating layer) formed of polyethylene, butyl rubber, or the like in place of the water stop sheet, and this insulating resin layer will be the water stop portion after swaging the barrel piece.

A swaging structure for an electric wire pinched by two barrel pieces is known in which one barrel piece (an inner barrel piece) is crimped while being wound around the electric wire, and the other barrel piece (an outer barrel piece) is crimped while being wound around the one barrel piece together with the electric wire as described in Japanese Patent Application Laid-open No. 2014-182957 and Japanese Patent Application Laid-open No. 2014-182958. In such a swaging structure, a space is formed in between the outer barrel piece and a sheath on the end face side of the distal end of the inner barrel piece. Depending on the volume of the space, the water stop property of the electric wire connecting portion may be degraded.

SUMMARY OF THE INVENTION

In view of the foregoing circumstances, an object of the present invention is to provide a crimp terminal with improved water stop property in an electric wire connecting portion.

In order to achieve the above mentioned object, a crimp terminal according to one aspect of the present invention includes a terminal metal fitting including a terminal connecting portion to be electrically connected to a counterpart terminal, an electric wire connecting portion to be electrically connected to an end of an electric wire placed on an inner wall face side by crimping processing, and a coupling portion coupling the terminal connecting portion and the electric wire connecting portion, the electric wire connecting portion being sectioned into a bottom portion on which the end of the electric wire is placed during the crimping processing, an inner first barrel piece that is caused to extend from one end of the bottom portion to be wound around the end of the electric wire, and an outer second barrel piece that is caused to extend from another end of the bottom portion longer than the first barrel piece does and to be wound around the end of the electric wire and the first barrel piece, and the electric wire connecting portion being sectioned into a core wire crimp portion to be crimped onto a distal-end core wire of the electric wire, a sheath crimp portion to be crimped on a sheath of the electric wire, and a coupling crimp portion coupling the core wire crimp portion and the sheath crimp portion and to be crimped onto the end of the electric wire; and a water stop member that forms a first water stop area that is affixed to the inner wall face of the electric wire connecting portion before performing the crimping processing and suppresses entry of water from a gap between an outer wall face of the first barrel piece and the inner wall face of the second barrel piece to a gap between the electric wire connecting portion and the core wire after completion of the crimping processing, a second water stop area that suppresses entry of water from the terminal connecting portion side of a distal end position of the core wire to the gap between the electric wire connecting portion and the core wire, and a third water stop area that suppresses entry of water from a gap between the inner wall face of the sheath crimp portion and the sheath to the gap between the electric wire connecting portion and the core wire, wherein the inner wall face of a distal end in an extension direction of the first barrel piece of the sheath crimp portion includes a tapered face that reduces a plate thickness of the first barrel piece from the bottom portion side toward an end face side of the distal end, and a part of the third water stop area is connected among the end face side of the distal end of the first barrel piece, the inner wall face side, and the outer wall face side.

According to another aspect of the present invention, in the crimp terminal, it is desirable that the second barrel piece makes a plate thickness of a portion adjacent to a space between the second barrel piece and the sheath on the end face side of the distal end of the first barrel piece smaller than surroundings of the portion.

According to still another aspect of the present invention, in the crimp terminal, it is desirable that the inner wall face side of the second barrel piece of the sheath crimp portion is provided with a tapered face that reduces the plate thickness of the second barrel piece toward an end face side of a distal end in an extension direction of the second barrel piece, in between the portion adjacent to the space and the end face.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
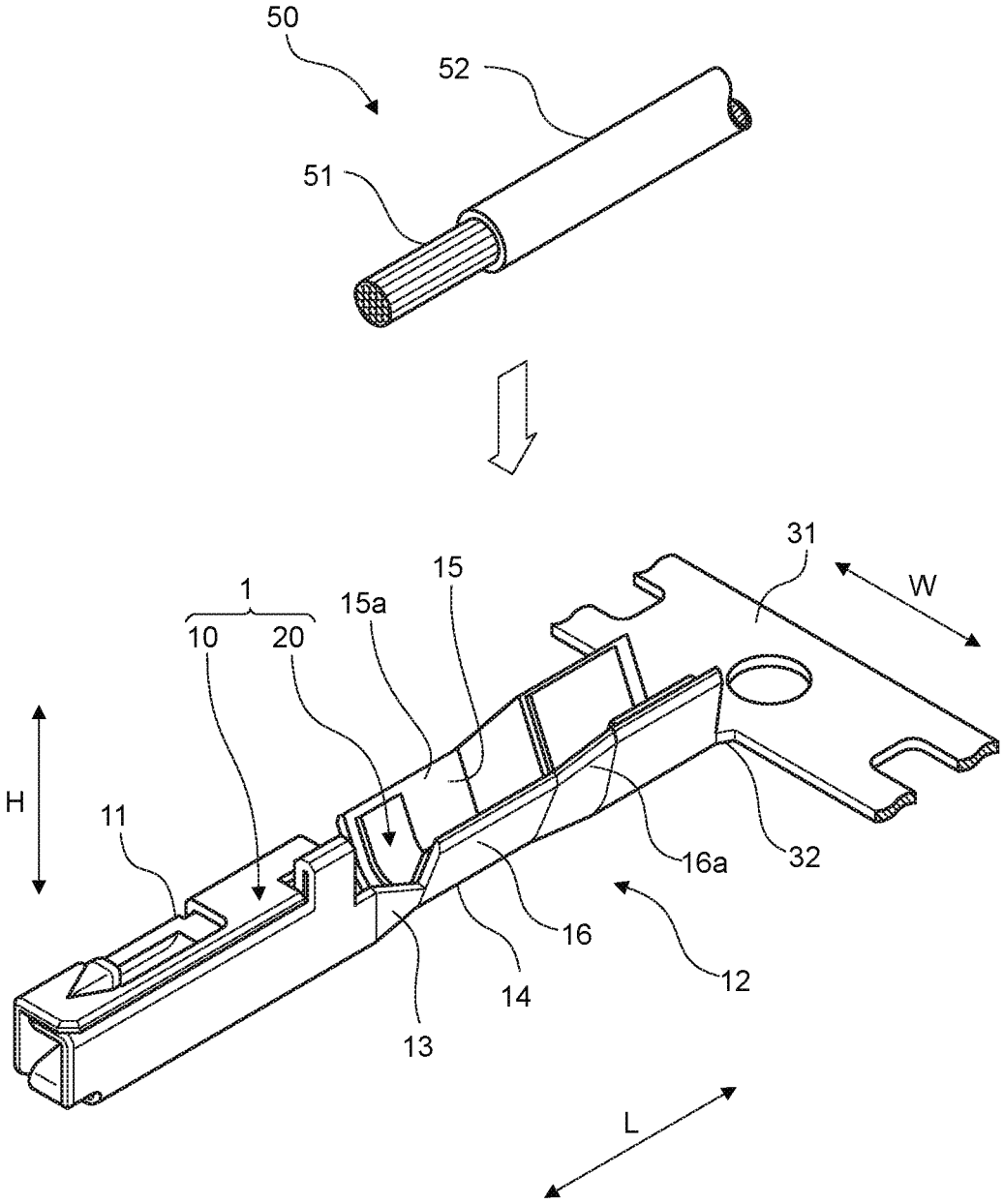
FIG. 1 is a perspective view of a crimp terminal according to an embodiment illustrating a state before being connected to an electric wire.
Figure 2:
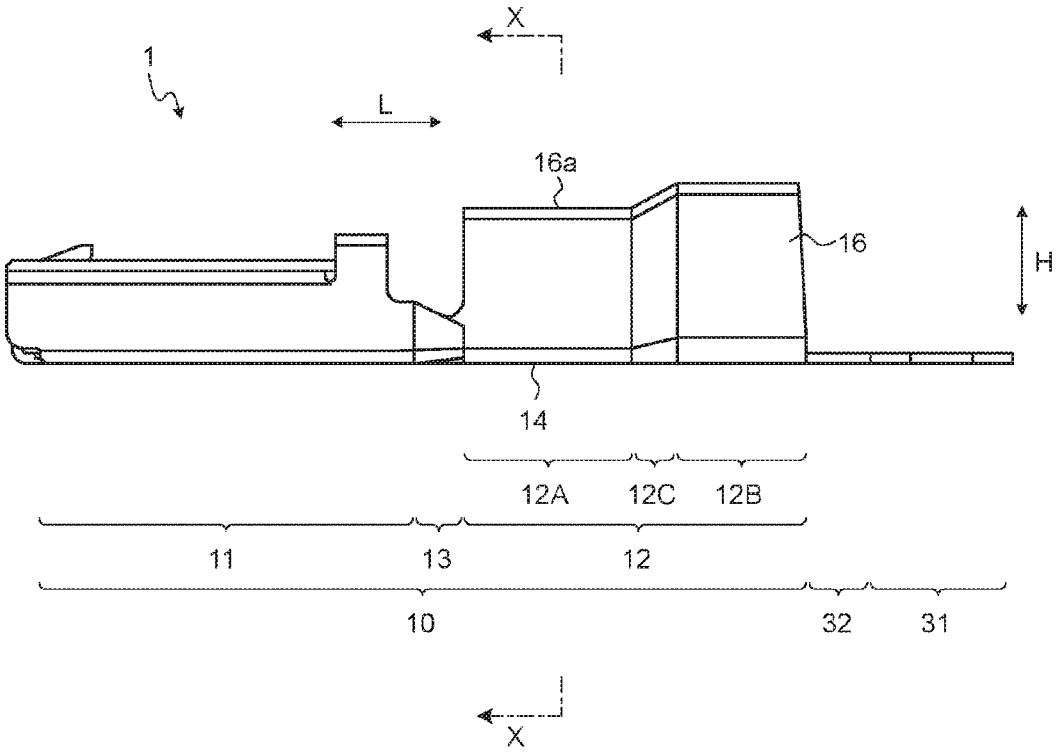
FIG. 2 is a side view of the crimp terminal according to the embodiment illustrating a state in which an electric wire connecting portion is formed in a U-shape.
Figure 3:
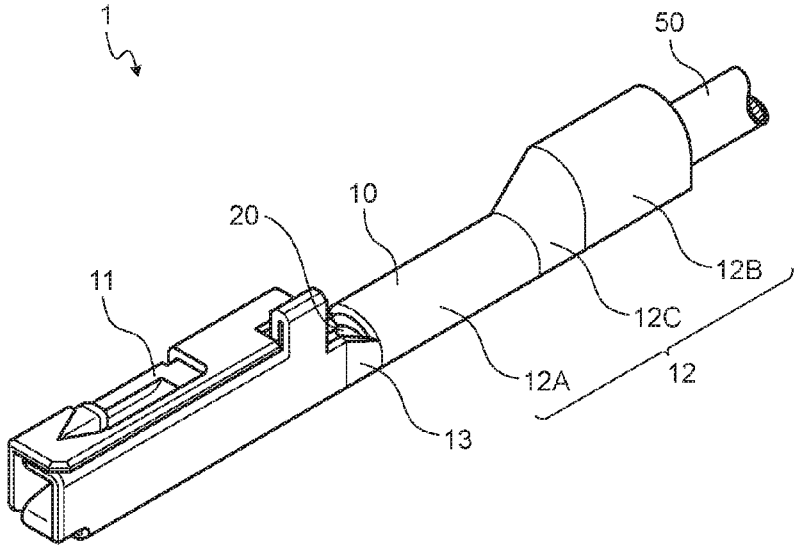
FIG. 3 is a perspective view of the crimp terminal after the completion of crimping in the embodiment.
Figure 4:
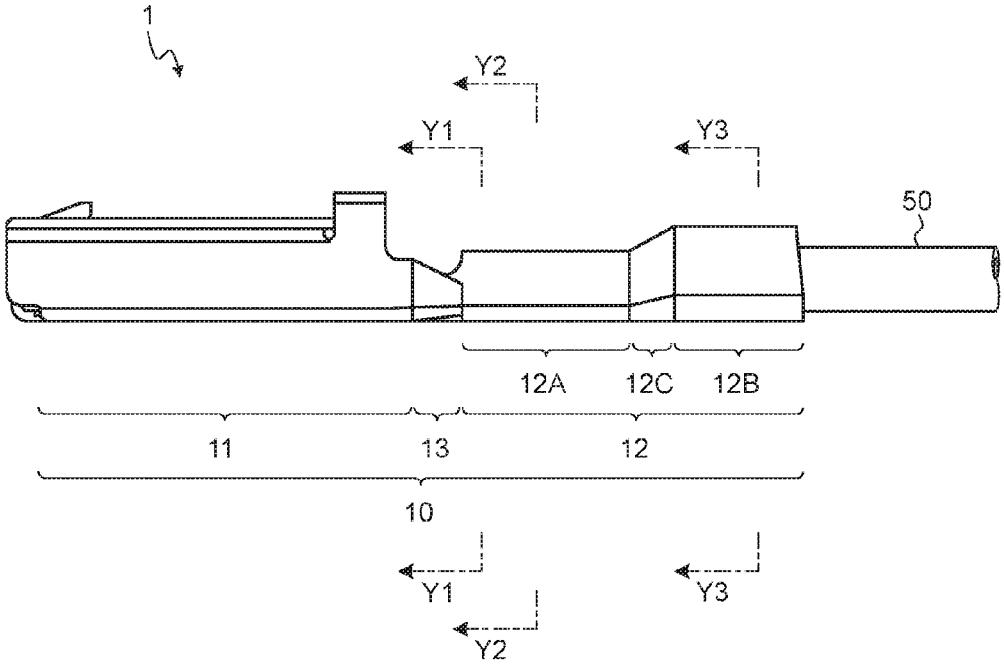
FIG. 4 is a side view of the crimp terminal after the completion of crimping in the embodiment.

The following describes an embodiment of a crimp terminal according to the present invention in detail based on the accompanying drawings. This embodiment does not limit this invention.

Embodiment

The following describes one embodiment of the crimp terminal according to the present invention based on FIG. 1 to FIG. 13.

Numeral 1 in FIG. 1 to FIG. 4 indicates the crimp terminal of the present embodiment. This crimp terminal 1 is electrically connected to an electric wire 50 and is electrically connected to a counterpart terminal (not illustrated) while being integrated with this electric wire 50. One end of the electric wire 50 has, to expose a core wire 51 thereof by a certain length, a sheath 52 peeled off to be removed by the length. The core wire 51 may be an aggregate of a plurality of elemental wires or a single wire such as a coaxial cable. The crimp terminal 1, to be electrically connected to the electric wire 50, is crimped onto the end of the electric wire 50 and is thereby electrically connected to the exposed core wire at the distal end (hereinafter, referred to simply as a "distal-end core wire") 51.

Specifically, the crimp terminal 1 includes a terminal metal fitting 10 and a water stop member 20.

Figure 5:
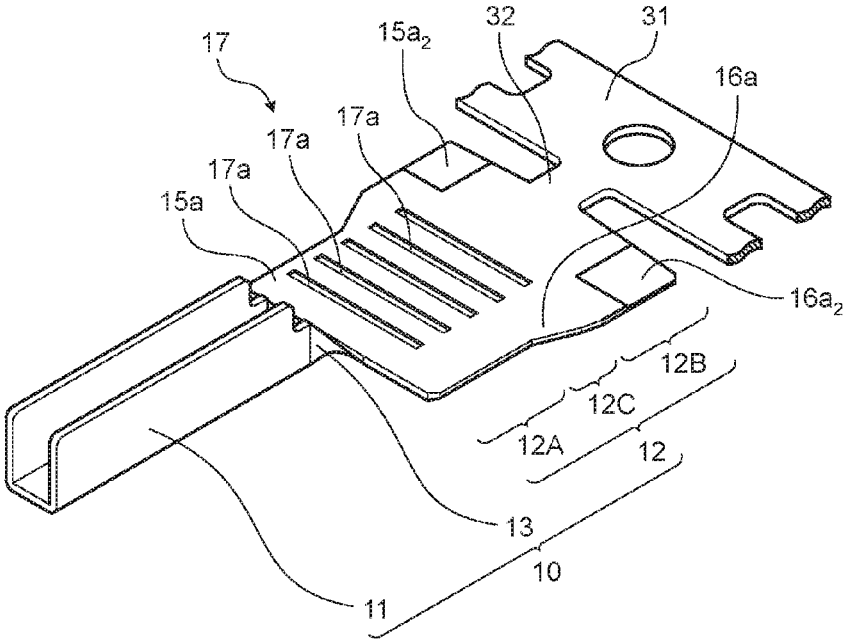
FIG. 5 is a perspective view of a terminal metal fitting of the crimp terminal according to the embodiment illustrating a state before a water stop member is affixed.

The terminal metal fitting 10 is the main part of this exemplary crimp terminal 1. This terminal metal fitting 10 is formed into a certain shape that can be connected to the counterpart terminal and the electric wire 50 by performing punching processing, bending processing, and the like on a conductive metal plate (a copper plate, for example) as a base material. As illustrated in FIG. 5, this terminal metal fitting 10 includes a terminal connecting portion 11 to be electrically connected to the counterpart terminal and an electric wire connecting portion 12 to be electrically connected to the electric wire 50. The terminal connecting portion 11 and the electric wire connecting portion 12 are coupled to each other via a coupling portion 13 interposed therebetween.

The terminal metal fitting 10 may be a male terminal or a female terminal. The terminal connecting portion 11 is formed in a male type when the terminal metal fitting 10 is the male terminal and is formed in a female type when the terminal metal fitting 10 is the female terminal. The present embodiment provides a female terminal as an example.

A direction along which the counterpart terminal is connected with this crimp terminal 1 (an insertion direction), which is a longitudinal direction of the crimp terminal 1, is defined as a first direction L. For the parallel arrangement direction of this crimp terminal 1, which will be described later, the width direction of the crimp terminal is defined as a second direction W. A direction orthogonal to both the first direction L and the second direction W, which is the height direction of the crimp terminal 1, is defined as a third direction H.

The electric wire connecting portion 12 is first formed in one plate shape (FIG. 5), subjected to certain processing, which will be described later, and then formed to a U shape serving as a state immediately before the connection with the electric wire 50 (FIG. 1). This electric wire connecting portion 12 is crimped onto the end of the electric wire 50, with the end of the electric wire 50 placed thereon, by being wound around the electric wire 50, and thereby comes into contact with the distal-end core wire 51.

Figure 6:
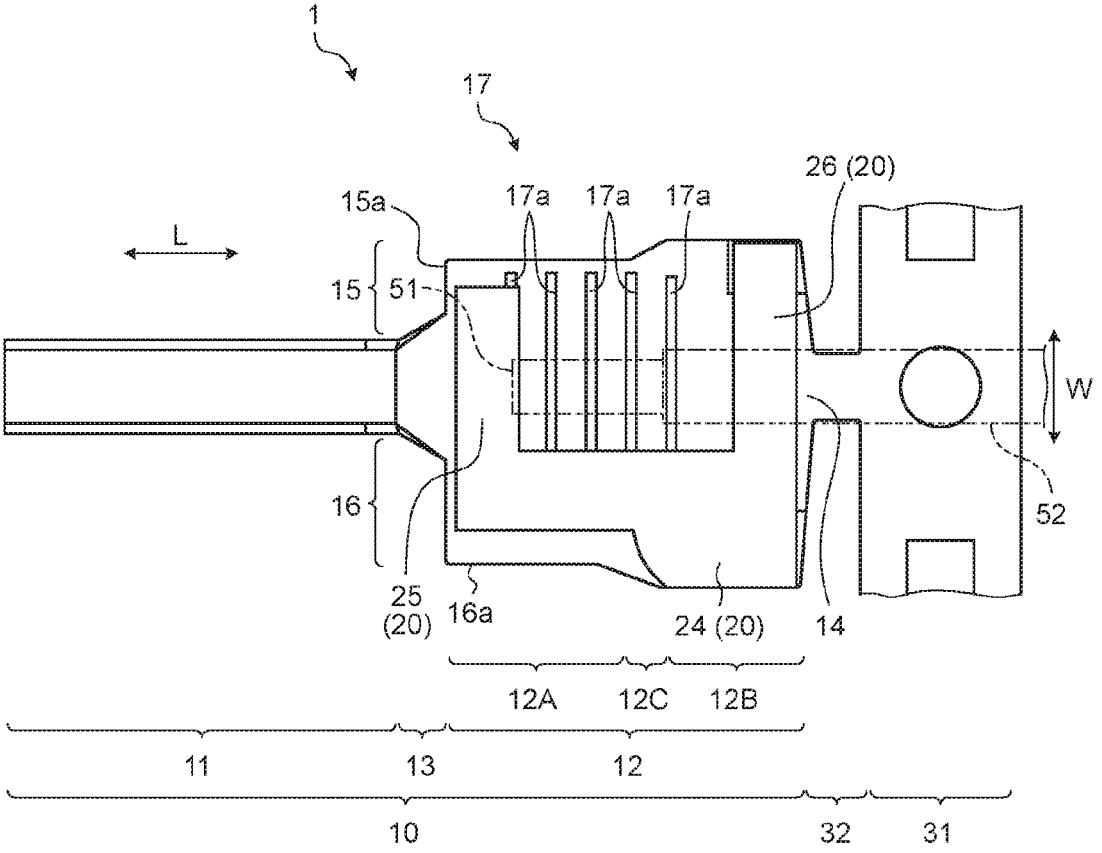
FIG. 6 is a top view of the terminal metal fitting of the crimp terminal according to the embodiment illustrating a state after the water stop member has been affixed.

This electric wire connecting portion 12 can be sectioned into the area of a bottom portion 14, the area of a first barrel piece 15, and the area of a second barrel piece 16 (FIG. 1 and FIG. 6). The bottom portion 14 is a portion that will be the bottom wall of the U-shaped electric wire connecting portion 12 later, on which the end of the electric wire 50 is placed during crimping processing. The first and second barrel pieces 15 and 16 are portions that will be the side walls of the U-shaped electric wire connecting portion 12 later and are caused to extend on both ends in the second direction W of the bottom portion 14. For the U-shaped electric wire connecting portion 12, the first and second barrel pieces 15 and 16 thereof extend from both ends of the bottom portion 14 so as to surround the end of the electric wire 50.

Figure 7:
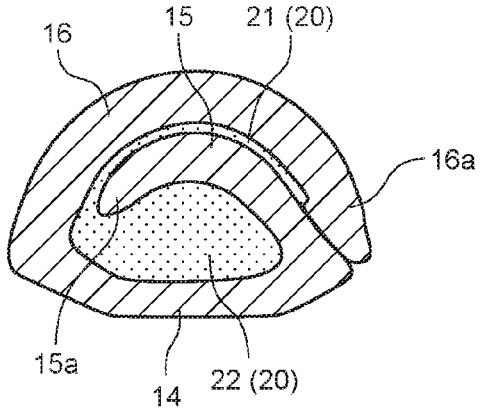
FIG. 7 is a diagram of a section of the electric wire connecting portion cut along the Y1-Y1 line in FIG. 4.
Figure 8:
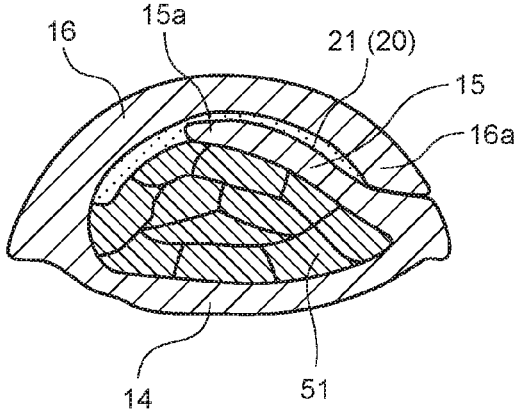
FIG. 8 is a diagram of a section of the electric wire connecting portion cut along the Y2-Y2 line in FIG. 4.
Figure 9:
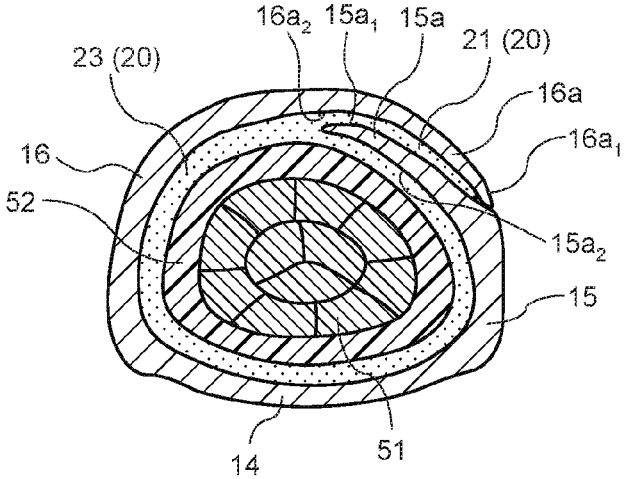
FIG. 9 is a diagram of a section of the electric wire connecting portion cut along the Y3-Y3 line in FIG. 4.

The first barrel piece 15 and the second barrel piece 16 may be formed such that the respective distances from the bases on the bottom portion 14 side to the end faces of distal ends 15*a* and 16*a* will be the same length or formed such that the distance will be longer in one than in the other. The present embodiment exemplifies the latter. That is, one of the distal ends 15*a* and 16*a* of the first barrel piece 15 and the second barrel piece 16 protrudes from the other in the third direction H in the U-shaped electric wire connecting portion 12. In this example, the second barrel piece 16 is caused to extend from the bottom portion 14 longer than the first barrel piece 15 does (FIG. 5 and FIG. 6). The first barrel piece 15 and the second barrel piece 16 are formed as being wound around the end of the electric wire 50 while overlapping each other. Consequently, in this electric wire connecting portion 12, an area in which the first barrel piece 15 and the second barrel piece 16 overlap each other (hereinafter, referred to as an "overlap area") is formed after the completion of crimping processing (hereinafter, referred to as "after the completion of crimping) (FIG. 7 to FIG. 9). The overlap area is specifically an area in which the outer wall face of the first barrel piece 15 and the inner wall face of the second barrel piece 16 face each other after the completion of crimping. In other words, in this electric wire connecting portion 12, the first barrel piece 15 is a barrel piece to be wound around the end of the electric wire 50 on the inner side, whereas the second barrel piece 16 is a barrel piece to be wound around the end of the electric wire 50 on the outer side. Consequently, during the crimping processing, the first barrel piece 15 is wound around the outer circumferential side of the end of the electric wire 50, and the second barrel piece 16 is wound so as to cover the end of the electric wire 50 and the first barrel piece 15 in this state from the outer circumferential side. In the electric wire connecting portion 12, the first barrel piece 15 and the second barrel piece 16 are thus crimped onto the end of the electric wire 50.

The end of the electric wire 50 is inserted from a U-shaped opening (an opening formed in between the end faces of the respective distal ends 15*a* and 16*a*) side of the electric wire connecting portion 12 into a U-shaped inner space. For this purpose, so as to make the end of the electric wire 50 easy to be inserted, in the electric wire connecting portion 12, the spacing between the first barrel piece 15 and the second barrel piece 16 becomes wider from the bottom portion 14 toward the opening (the distal ends 15*a* and 16*a*).

Furthermore, this electric wire connecting portion 12 can be sectioned into the area of a core wire crimp portion 12A, the area of a sheath crimp portion 12B, and the area of a coupling crimp portion 12C (FIG. 2 and FIG. 4 to FIG. 6). The core wire crimp portion 12A is a portion to be crimped onto the distal-end core wire 51 and is connected to the coupling portion 13. The sheath crimp portion 12B is a portion to be crimped onto the sheath 52 connected to the base of the exposed portion of the distal-end core wire 51. The coupling crimp portion 12C is a portion coupling the core wire crimp portion 12A and the sheath crimp portion 12B and to be crimped onto the end of the electric wire 50.

The electric wire connecting portion 12 is provided with a core wire holding area (hereinafter, referred to as a "serration area") 17 for holding the crimped distal-end core wire 51 on the inner wall face (the wall face on the side covering the electric wire 50) thereof (FIG. 5 and FIG. 6). The serration area 17 is arranged at least at the portion to be wound around the distal-end core wire 51 in the inner wall face of the electric wire connecting portion 12. This exemplary serration area 17 is formed to cover the distal-end core wire 51 on the whole. Specifically, the serration area 17 of the present embodiment arranges a plurality of recesses, a plurality of protrusions, or a combination of a plurality of recesses and projections in a rectangular shape and is for increasing the contact area between the electric wire connecting portion 12 and the distal-end core wire 51 through the recesses or the protrusions and increasing the contact strength therebetween. In this example, a plurality of recesses 17*a* form the rectangular serration area 17.

The electric wire connecting portion 12 and the distal-end core wire 51 are required to be electrically connected to each other. For this reason, the entry of water to the gap therebetween may degrade durability, which is unfavorable. When the electric wire connecting portion 12 and the distal-end core wire 51 are formed of different kinds of metallic materials having different ionization tendencies (copper and aluminum or the like), for example, the entry of water to the gap therebetween can corrode, in particular, the aluminum side therebetween. Given this situation, this crimp terminal 1 is provided with the water stop member 20 for suppressing the entry of water to the gap between the electric wire connecting portion 12 and the distal-end core wire 51 (FIG. 1 and FIG. 6). This water stop member 20 is formed in a sheet shape with an adhesive such as a modified acrylic-based adhesive as a main component. For the water stop member 20, one in which a sheet-shaped nonwoven fabric is impregnated with an adhesive to have an adhesive effect on both faces of the sheet is used, for example. When the electric wire connecting portion 12 and the core wire 51 are formed of a metallic material of the same type (copper or the like), for example, the water stop member 20 is not necessarily required to be provided.

The water stop member 20 forms first to third water stop areas 21, 22, and 23 after the completion of crimping (FIG. 7 to FIG. 9). To implement the arrangement of the first to third water stop areas 21, 22, and 23, the water stop member 20 is formed in a certain shape and is affixed to the inner wall face of the flat electric wire connecting portion 12 illustrated in FIG. 5.

The first water stop area 21 is an area in which the water stop member 20 is interposed between the outer wall face of the first barrel piece 15 and the inner wall face of the second barrel piece 16 (that is, the overlap area) at least after the completion of crimping (FIG. 7 to FIG. 9) and that suppresses the entry of water from the gap therebetween to the gap between the electric wire connecting portion 12 and the distal-end core wire 51. For this purpose, the first water stop area 21 is caused to extend between the terminal connecting portion 11 side of the tip position of the distal-end core wire 51 and the sheath 52 side of the base of the distal-end core wire 51. The first water stop area 21 is formed by a first water stop portion 24 of the water stop member 20 (FIG. 6).

The first water stop portion 24 is arranged in between the distal end 16*a* side of the second barrel piece 16 and the bottom portion 14 side across the terminal connecting portion 11 side of the tip position of the distal-end core wire 51 and the sheath 52 side of the base of the distal-end core wire 51. The bottom portion 14 side of this first water stop portion 24 is caused to extend to a position that covers the second barrel piece 16 side of the serration area 17. Consequently, this exemplary first water stop area 21 is not only formed in the overlap area but also in between the inner wall face of the second barrel piece 16 and the distal-end core wire 51 to the extent that the electric connection between the second barrel piece 16 and the distal-end core wire 51 is not impaired (FIG. 8).

The second water stop area 22 is an area filled with the water stop member 20 on the terminal connecting portion 11 side of the tip position of the distal-end core wire 51 inside the electric wire connecting portion 12 at least after the completion of crimping (FIG. 7) and that suppresses the entry of water from its terminal connecting portion 11 side to the gap between the electric wire connecting portion 12 and the distal-end core wire 51. The second water stop area 22 is formed mainly by a second water stop portion 25 of the water stop member 20 (FIG. 6).

The second water stop portion 25 is arranged in between the distal end 15*a* side of the first barrel piece 15 and the first water stop portion 24 across the terminal connecting portion 11 side of the tip position of the distal-end core wire 51 and the tip portion side of the distal-end core wire 51. The exemplary second water stop portion 25 is arranged so as to cover the tip portion of the distal-end core wire 51. Consequently, in the exemplary second water stop area 22, the tip portion of the core wire 51 is also covered with the water stop member 20 (the second water stop portion 25). The exemplary second water stop portion 25 is connected to the first water stop portion 24. Consequently, the exemplary second water stop area 22 is formed by the second water stop portion 25 and a connecting portion of the first water stop portion 24 with the second water stop portion 25 (the bottom portion 14 side of the overlap area).

The third water stop area 23 is an area in which the water stop member 20 is interposed between the inner wall face of the electric wire connecting portion 12 (specifically, the sheath crimp portion 12B) and the sheath 52 at least after the completion of crimping (FIG. 9) and that suppresses the entry of water from the gap therebetween to the gap between the electric wire connecting portion 12 and the distal-end core wire 51. The third water stop area 23 is formed mainly by a third water stop portion 26 of the water stop member 20 (FIG. 6).

The third water stop portion 26 is arranged in between the distal end 15*a* side of the first barrel piece 15 and the first water stop portion 24 and at a portion of the electric wire connecting portion 12 to be wound around the sheath 52. The exemplary third water stop portion 26 is connected to the first water stop portion 24. Consequently, this third water stop area 23 is formed by the third water stop portion 26 and a connecting portion of the first water stop portion 24 with the third water stop portion 26 (the bottom portion 14 side of the overlap area).

The water stop member 20 is formed as the first to third water stop areas 21, 22, and 23 in a connected condition after the completion of crimping by arranging the portions having such shapes on the inner wall face of the electric wire connecting portion 12. The first to third water stop areas 21, 22, and 23 cut off the communication between the end of the electric wire 50 and the outside in the electric wire connecting portion 12. Consequently, this water stop member 20 can suppress the entry of water to the gap between the electric wire connecting portion 12 and the distal-end core wire 51.

The terminal metal fitting 10 described above is formed into the form having the flat electric wire connecting portion 12 illustrated in FIG. 5 through a press process on one flat metallic plate as a base material, and the water stop member 20 is affixed to the flat electric wire connecting portion 12 in the following water stop member affixing process. After that, the terminal metal fitting 10 is formed with the terminal connecting portion 11 and is formed with the U-shaped electric wire connecting portion 12 in a bending process.

Figure 10:
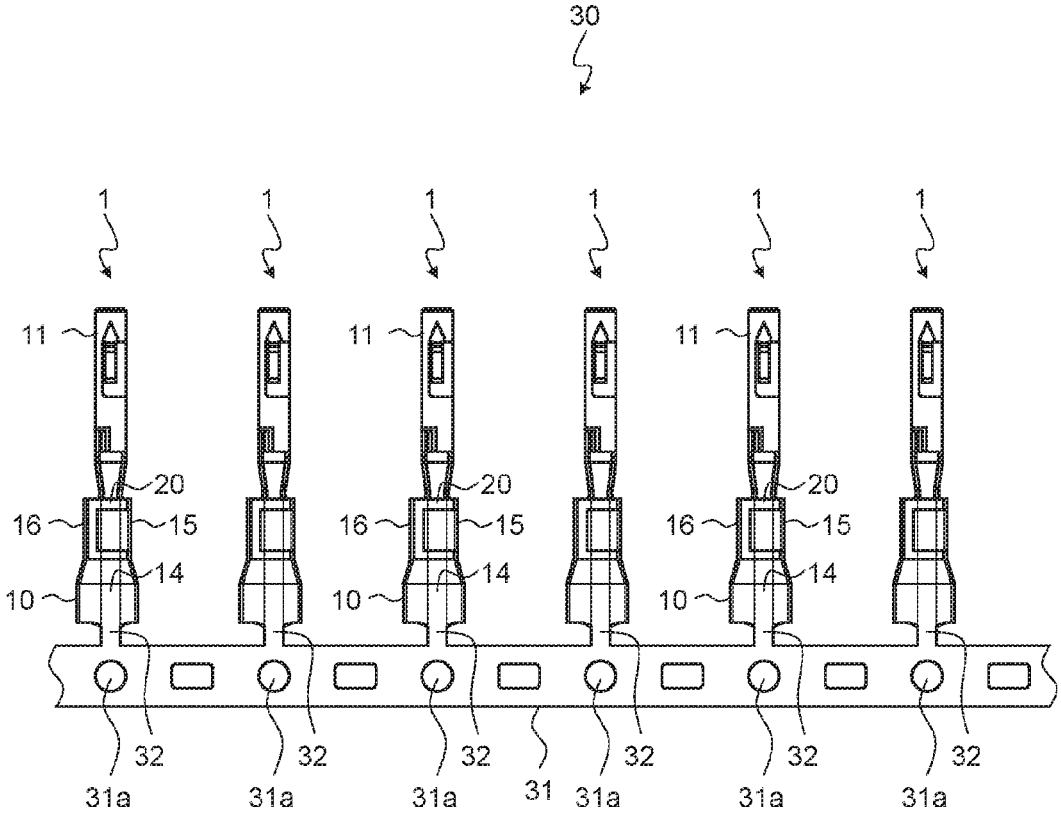
FIG. 10 is a diagram illustrating a terminal chained body.

The crimp terminal 1 having passed through the above process is formed as a chained body 30 (hereinafter, referred to as a "terminal chained body") in which a plurality of ones are arranged (FIG. 10). The terminal chained body 30 refers to an aggregate of a plurality of crimp terminals 1 that are arranged side by side equally spaced apart from each other and are connected in a chain shape while being directed in the same direction. In the terminal chained body 30, the one ends of all the crimp terminals 1 are connected by a coupling piece 31. The coupling piece 31 is formed in a rectangular plate shape, for example, and is arranged with a certain spacing relative to the respective electric wire connecting portions 12 of all the crimp terminals 1. The bottom portion 14 of the electric wire connecting portion 12 and the coupling piece 31 are connected via a rectangular plate-shaped connecting portion 32, for example, for each of the crimp terminals 1. The coupling piece 31 is formed with through holes (hereinafter, referred to as "terminal feeding holes") 31*a* for feeding the terminal chained body 30 to the crimp position of a terminal crimping device 100 equally spaced apart from each other in the direction of feeing the terminal chained body 30. The thus formed terminal chained body 30 is arranged in the terminal crimping device 100 in the form of being wound in a reel shape (not illustrated). The crimp terminals 1 are crimped onto the electric wires 50 and are then cut off from the terminal chained body 30.

The following describes the terminal crimping device 100.

Figure 11:
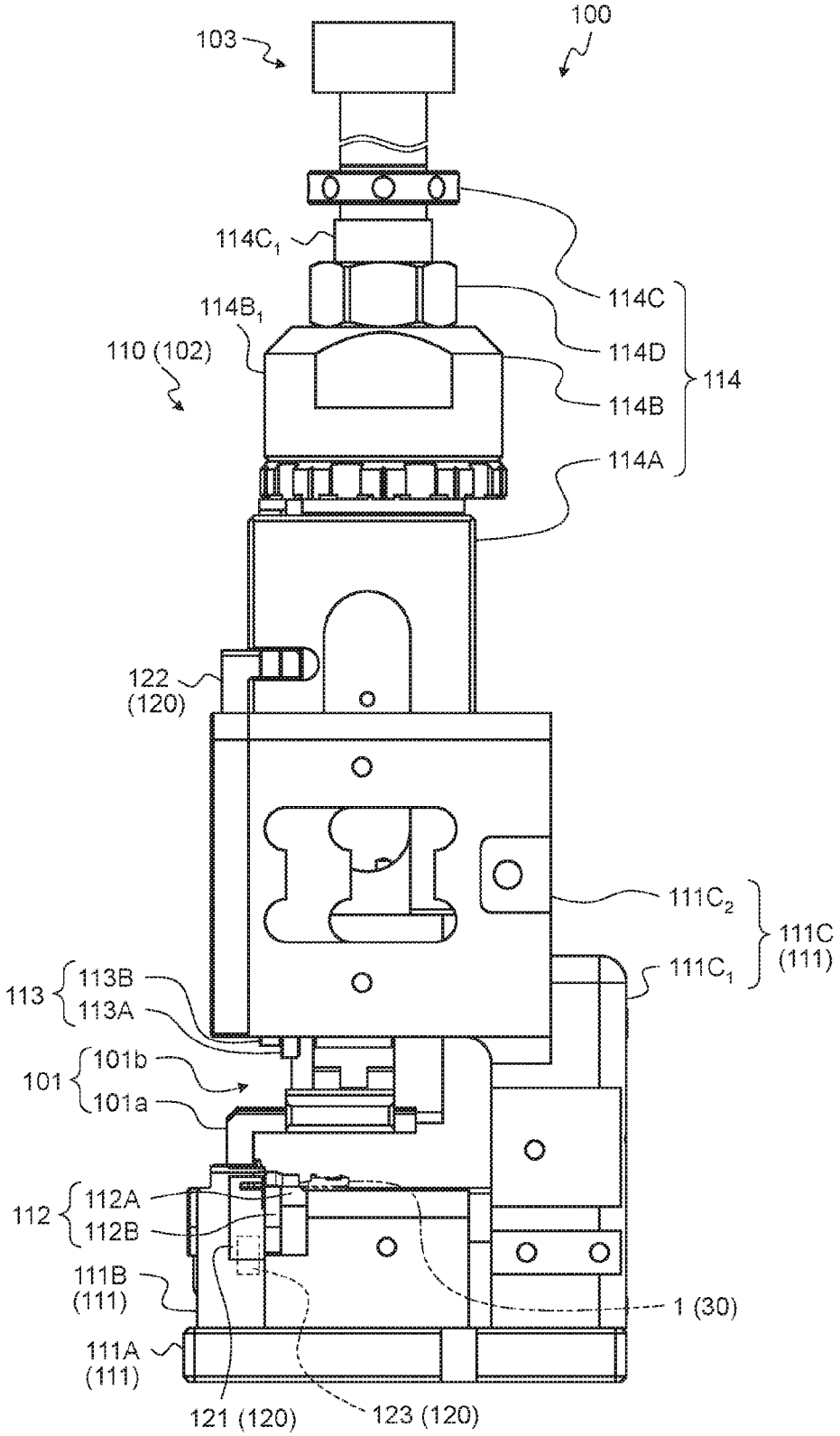
FIG. 11 is a diagram illustrating a terminal crimping device according to the embodiment.

As illustrated in FIG. 11, the terminal crimping device 100 includes a terminal supply device 101 that supplies the crimp terminal 1 to a certain crimp position, a crimping device 102 that crimps the crimp terminal 1 onto the electric wire 50 at the crimp position, and a drive unit 103 that operates the terminal supply device 101 and the crimping device 102. The terminal supply device 101 and the crimping device 102 are devices called applicators in this technical field.

The terminal supply device 101 pulls out the top crimp terminal 1 on the outer circumferential side of the terminal chained body 30 wound in a reel shape to feed the top crimp terminal 1 to the crimp position in succession. After completing the crimping of the top crimp terminal 1 onto the electric wire 50 and the cutting of the top crimp terminal 1 from the terminal chained body 30, the terminal supply device 101 feeds the new top crimp terminal 1 to the crimp position. This terminal supply device 101 repeats the operation in succession each time the crimping processing and the cutting processing are performed.

This terminal supply device 101 has a configuration well known in this technical field and includes a terminal feeding member 101*a* to be inserted into the terminal feeding holes 31*a* of the coupling piece 31 and a power transmission mechanism 101*b* that drives the terminal feeding member 101*a* by the power of the drive unit 103. The power transmission mechanism 101*b* is configured as a link mechanism operating in conjunction with the crimping operation (the up-and-down motion of a ram 114A and the like described below) of the crimping device 102. This exemplary terminal supply device 101 drives the terminal feeding member 101*a* in an up-and-down direction and a right-and-left direction in conjunction with the crimping operation of the crimping device 102 to feed the crimp terminal 1 to the crimp position.

The crimping device 102 performs the crimping of the fed crimp terminal 1 onto the electric wire 50 and the cutting of this crimp terminal 1 from the terminal chained body 30. For this purpose, this crimping device 102 includes a crimping machine 110 and a terminal cutting body 120.

The crimping machine 110 is a device that crimps the crimp terminal 1 fed to the crimp position onto the end of the electric wire 50, thereby crimping the crimp terminal 1 onto the electric wire 50. This exemplary crimping machine 110 crimps the first barrel piece 15 and the second barrel piece 16 of the crimp terminal 1 onto the distal-end core wire 51 and the sheath 52 of the electric wire 50, respectively, thereby crimping this crimp terminal 1 onto the electric wire 50. This crimping machine 110 includes a frame 111, a first mold 112 and a second mold 113 in pairs, and a power transmission mechanism 114.

The frame 111 includes a base 111A, an anvil support 111B, and a support 111C for the power transmission mechanism 114 (hereinafter, referred to as a "transmission unit support"). The base 111A is fixed onto a mounting base (not illustrated) on which the terminal crimping device 100 is mounted, for example. The anvil support 111B and the transmission unit support 111C are fixed onto the base 111A. The transmission unit support 111C is arranged behind (the right side in FIG. 11) and above (the upper side in FIG. 11) the anvil support 111B. Specifically, this transmission unit support 111C includes an erected portion $\mathbf{111}C_1$ erected from the base 111A upward behind the anvil support 111B and a ram support $\mathbf{111}C_2$ held above this erected portion $\mathbf{111}C_1$. The ram support $\mathbf{111}C_2$ is a support supporting the ram 114A described below and is arranged above the anvil support 111B with a certain spacing therefrom.

Figure 12:
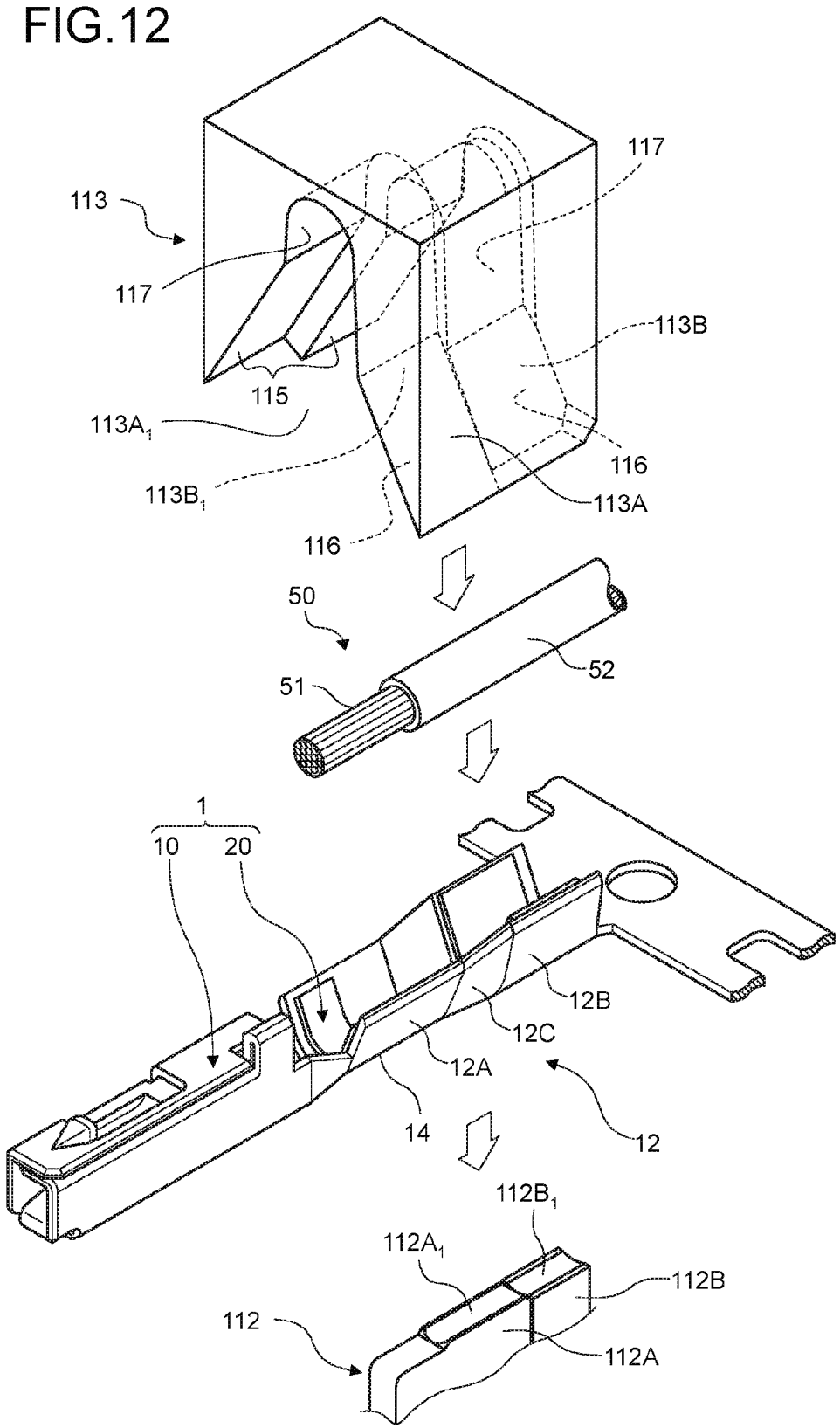
FIG. 12 is a perspective view illustrating first and second molds according to the embodiment.

The first mold 112 and the second mold 113 are arranged spaced apart from each other in the up-and-down direction and form a crimp forming mold that pinches the crimp terminal 1 and the end of the electric wire 50 arranged therebetween to crimp the crimp terminal 1 onto the end of the electric wire 50 (FIG. 12). The first mold 112 is formed of two lower molds and includes a first anvil 112A and a second anvil 112B as the lower molds. The second mold 113 is formed of two upper molds and includes a first crimper 113A and a second crimper 113B as the upper molds. The first anvil 112A and the first crimper 113A are arranged facing each other in the up-and-down direction and narrow the gap therebetween to crimp the U-shaped core wire crimp portion 12A onto the distal-end core wire 51. The second anvil 112B and the second crimper 113B are arranged facing each other in the up-and-down direction and narrow the gap therebetween to crimp the U-shaped sheath crimp portion 12B onto the sheath 52.

The drive unit 103 transmits its power to the power transmission mechanism 114, thereby narrowing the gap between the first anvil 112A and the first crimper 113A and the gap between the second anvil 112B and the second crimper 113B during such crimping processing and widening the gap between the first anvil 112A and the first crimper 113A and the gap between the second anvil 112B and the second crimper 113B after the crimping processing. In this example, the second mold 113 is moved upward and downward relative to the first mold 112, thereby simultaneously moving the first crimper 113A and the second crimper 113B upward and downward relative to the first anvil 112A and the second anvil 112B, respectively. However, the first anvil 112A, the second anvil 112B, the first crimper 113A, and the second crimper 113B may be formed bodies individually formed; in this case, the drive unit 103 and the power transmission mechanism 114 may separately move the first crimper 113A and the second crimper 113B upward and downward. In this example, after the crimping of the core wire crimp portion 12A has started by the first anvil 112A and the first crimper 113A, the crimping of the sheath crimp portion 12B by the second anvil 112B and the second crimper 113B starts.

The power transmission mechanism 114 of the present embodiment transmits the power output from the drive unit 103 to the first crimper 113A and the second crimper 113B and includes the ram 114A, a ram bolt 114B, and a shank 114C as illustrated in FIG. 11.

The ram 114A is a movable member supported in such a manner as being freely movable upward and downward relative to the ram support 111$C_2$. The second mold 113 is fixed to this ram 114A. Given this situation, the first crimper 113A and the second crimper 113B can move upward and downward relative to the ram support 111$C_2$ integrally with the ram 114A. This ram 114A is formed in a rectangular parallelepipedal shape, for example. This ram 114A is formed with a female screw portion (not illustrated). This female screw portion is formed on the inner peripheral face of a hole in the up-and-down direction formed from the inside of the ram 114A toward an upper end face.

The ram bolt 114B includes a male screw portion (not illustrated) to be screwed with the female screw portion of the ram 114A. Given this situation, the ram bolt 114B can move upward and downward relative to the ram support 111$C_2$ integrally with the ram 114A. This ram bolt 114B includes a bolt head 114$B_1$ arranged above the male screw portion. The bolt head 114$B_1$ is formed with a female screw portion (not illustrated). The female screw portion is formed on the inner peripheral face of a hole in the up-and-down direction formed from the inside of the bolt head 114$B_1$ toward an upper end face.

The shank 114C is a cylindrical, hollow member and includes a male screw portion 114$C_1$ and a connecting portion (not illustrated) at the respective ends. This male screw portion 114$C_1$ of the shank 114C is formed in the lower portion of the hollow member and is screwed with the female screw portion of the bolt head 114$B_1$ of the ram bolt 114B. Given this situation, the shank 114C can move upward and downward relative to the ram support 111$C_2$ integrally with the ram 114A and the ram bolt 114B. The connecting portion is connected to the drive unit 103.

The drive unit 103 includes a driving source (not illustrated) and a power conversion mechanism (not illustrated) that converts the drive power of the driving source into power in the up-and-down direction. The connecting portion of the shank 114C is coupled to the output shaft of the power conversion mechanism. Given this situation, the first crimper 113A and the second crimper 113B move upward and downward relative to the ram support 111$C_2$ integrally with the ram 114A, the ram bolt 114B, and the shank 114C by the output of the drive unit 103 (the output of the power conversion mechanism). Examples of the driving source include electric actuators such as electric motors, hydraulic actuators such as hydraulic cylinders, and pneumatic actuators such as air cylinders.

The relative position in the up-and-down direction of the first crimper 113A relative to the first anvil 112A and the relative position in the up-and-down direction of the second crimper 113B relative to the second anvil 112B can be changed by adjusting a screwed amount between the female screw portion of the bolt head 114$B_1$ and the male screw portion 114$C_1$ of the shank 114C. A nut 114D is screwed with the male screw portion 114$C_1$ of the shank 114C above the ram bolt 114B and serves as what is called a lock nut together with the female screw portion of the bolt head 114$B_1$. Given this situation, this nut 114D is tightened toward the ram bolt 114B after the completion of the adjustment of the relative positions, thereby enabling the first crimper 113A and the second crimper 113B to be fixed to the respective relative positions.

The first anvil 112A and the second anvil 112B are formed with recessed faces 112$A_1$ and 112$B_1$ recessed downward at the respective upper ends (FIG. 12). The recessed faces 112$A_1$ and 112$B_1$ are formed in an arc shape in accordance with the shapes of the respective bottom portions 14 of the U-shaped core wire crimp portion 12A and the U-shaped sheath crimp portion 12B. In this crimping machine 110, the recessed faces 112$A_1$ and 112$B_1$ serve as the crimp positions. As to the crimp terminal 1 fed with the bottom portion 14 directed downward, the bottom portion 14 of the core wire crimp portion 12A is placed on the recessed face 112$A_1$ at the upper end of the first anvil 112A, whereas the bottom portion 14 of the sheath crimp portion 12B is placed on the recessed face 112$B_1$ at the upper end of the second anvil 112B. The first mold 112 is supported by the anvil support 111B with the recessed faces 112$A_1$ and 112$B_1$ exposed upward.

Figure 13:
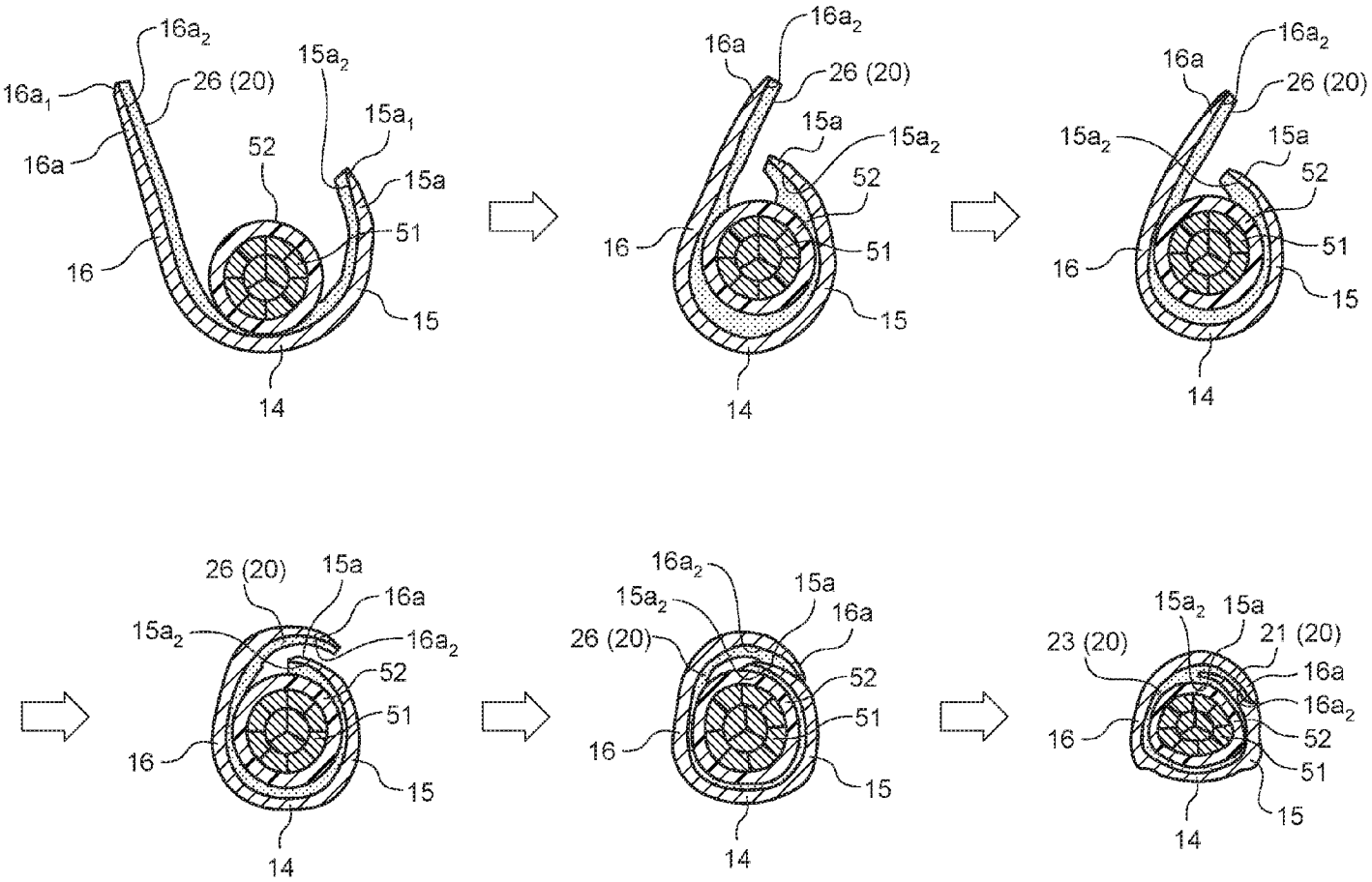
FIG. 13 is a diagram illustrating a crimping process on a portion cut along the Y3-Y3 line in FIG. 4.

The first crimper 113A and the second crimper 113B are formed with recessed portions 113$A_1$ and 113$B_1$, respectively, recessed upward (FIG. 12). The recessed portions 113$A_1$ and 113$B_1$ are arranged facing the respective recessed faces 112$A_1$ and 112$B_1$ of the first anvil 112A and the second anvil 112B, respectively, in the up-and-down direction. The recessed portions 113$A_1$ and 113$B_1$ each include first and second wall faces 115 and 116 facing each other and a third wall face 117 connecting the respective upper ends of the first and second wall faces 115 and 116. The recessed portions 113$A_1$ and 113$B_1$ each, while bringing the first to third wall faces 115, 116, and 117 into contact with the first barrel piece 15 and the second barrel piece 16, crimps the end of the electric wire 50 with the first barrel piece 15 and the second barrel piece 16 while winding the first barrel piece 15 and the second barrel piece 16 around the end of the electric wire 50. The recessed portions 113$A_1$ and 113$B_1$ are formed so as to enable such crimping operation to be performed. In the present embodiment, the shorter first barrel piece 15 is first wound from the distal end 15*a* side to the electric wire 50 side in succession, and the longer second barrel piece 16 is then wound around the first barrel piece 15 and the electric wire 50 while being wound to the electric wire 50 side. FIG. 13 is a diagram illustrating a crimping process on a portion (a crimping portion onto the sheath 52) cut along the Y3-Y3 line in FIG. 4. This drawing omits the first and second molds 112 and 113 for the sake of convenience of illustration.

The crimp terminal 1 subjected to the crimping processing by this crimping machine 110 in the manner described above is cut off from the coupling piece 31 by the terminal cutting machine 120. The terminal cutting machine 120 pinches and cuts the connecting portion 32 of the crimp terminal 1 fed to the crimp position by two terminal cutting units and performs the cutoff simultaneously with the progress of the crimping process. The terminal cutting machine 120 is arranged at the front side (the left side in FIG. 11) of the second anvil 112B.

The terminal cutting machine 120 is well known in this technical field and includes a terminal cutting body 121, a depressing member 122, and an elastic member 123, for example. The terminal cutting body 121 is arranged so as to be able to slide on the front face of the second anvil 112B in the up-and-down direction. In this terminal cutting machine 120, the terminal cutting body 121 and the second anvil 112B are formed with respective terminal cutting units. The depressing member 122 is fixed to the ram 114A and moves upward and downward integrally with the ram 114A. This depressing member 122 is arranged above the terminal cutting body 121 and descends to press down the terminal cutting body 121. The elastic member 123 applies an upward biasing force to the terminal cutting body 121 and is formed of a spring or the like. When a pressing-down force from the depressing member 122 is released, this elastic member 123 returns the terminal cutting body 121 to an initial position in the up-and-down direction. In this terminal cutting machine 120, the depressing member 122 descends along with the descending of the second mold 113 during the crimping processing and presses down the terminal cutting body 121, thereby cutting the connecting portion 32 by the respective terminal cutting units and cutting off the crimp terminal 1 from the terminal chained body 30.

On the outer wall face sides of the distal ends 15*a* and 16*a* of the first barrel piece 15 and the second barrel piece 16, respectively, tapered faces 15$a_1$ and 16$a_1$ that reduce the plate thicknesses of the distal ends 15*a* and 16*a* from the bottom portion 14 side toward the end face side of the distal ends 15*a* and 16*a* are preferably provided (FIG. 13). The tapered faces 15$a_1$ and 16$a_1$ may be formed in the press process on the electric wire connecting portion 12. The crimp terminal 1 of the present embodiment can increase the spacing between the distal end 15*a* and a first wall face 115 by the tapered distal ends 15*a* and 16*a* and can make thin the end face side of the distal end 16*a* to be inserted into therebetween, whereby the end faces of the distal end 15*a* and distal end 16*a* are suppressed from coming into contact with each other in the crimping process, and the second barrel piece 16 is easily inserted into between the first barrel piece 15 and the first wall face 115. Consequently, the crimp terminal 1 can perform desired crimping processing and can also improve water stop property by the water stop member 20.

In the sheath crimp portion 12B after the completion of crimping, the distal end 15*a* of the first barrel piece 15 covering the sheath 52 is further covered with the second barrel piece 16 from the outside. Thus, if the water stop member 20 is not affixed, a space surrounded by the end face, the inner wall face of the second barrel piece 16, and the outer wall face of the sheath 52 is formed on the end face side of the distal end 15*a* of the first barrel piece 15. When the plate thickness of the distal end 15*a* of the first barrel piece 15 is larger, the spacing between the inner wall face of the second barrel piece 16 and the outer wall face of the sheath 52 is larger, and the space increases in volume. Given this situation, in the sheath crimp portion 12B, when the volume of the space is larger, it is difficult to fill the space with the water stop member 20, which may degrade water stop property. In this example, the space is referred to as a "water stop member-filled space" for the sake of convenience.

Given these circumstances, the present embodiment narrows the spacing between the inner wall face of the second barrel piece 16 and the outer wall face of the sheath 52, thereby reducing the volume of the water stop member-filled space and enabling the water stop member-filled space to be filled with the water stop member 20. Specifically, a tapered face 15$a_2$ that reduces the plate thickness of the distal end 15*a* from the bottom portion 14 side toward the end face side of the distal end 15*a* is provided on the inner wall face side of the distal end 15*a* of the first barrel piece 15 of the sheath crimp portion 12B (FIG. 9 and FIG. 13). The tapered face 15$a_2$ may be formed in the press process for the electric wire connecting portion 12. The tapered face 15$a_2$ narrows the spacing between the inner wall face of the second barrel piece 16 and the outer wall face of the sheath 52 on the end face side of the distal end 15*a* of the first barrel piece 15 in the sheath crimp portion 12B after the completion of crimping. Thus, the volume of the water stop member-filled space can be reduced. Consequently, in the sheath crimp portion 12B after the completion of crimping, the filing amount of the water stop member 20 to the water stop member-filled space decreases. Thus, the filling efficiency of the water stop member 20 to the water stop member-filled space increases (that is, the water stop member 20 (especially the third water stop portion 26) easily flows into the water stop member-filled space during the crimping processing), which makes the water stop member-filled space easy to be filled with the water stop member 20.

In the third water stop area 23, an area (a first area) in which the water stop member 20 is filled in the water stop member-filled space, an area (a second area) in which the water stop member 20 is filled in the gap between the inner wall face of the distal end 15*a* of the first barrel piece 15 and the outer wall face of the sheath 52, and an area (a third area) in which the water stop member 20 is filled in the gap between the outer wall face of the distal end 15*a* and the inner wall face of the second barrel piece 16 are connected to one another on the end face of the distal end 15*a* and its surroundings (FIG. 9). Consequently, the crimp terminal 1 of the present embodiment can first suppress the entry of water to the inside of the sheath crimp portion 12B by the water stop member 20 filled in the third area and, if by any chance water enters through the third area, suppress the entry of water to the inside of the sheath crimp portion 12B (in further other words, the gap between the second barrel piece 16 and the sheath 52) by the water stop member 20 filled in the first area and the second area. The crimp terminal 1 of the present embodiment can thus improve water stop property between the second barrel piece 16 and the sheath 52.

As described above, this crimp terminal 1 provides the tapered face $\mathbf{15}a_1$ for suppressing the contact between the respective end faces of the distal ends 15*a* and 16*a* on the outer wall face side of the distal end 15*a*. The sheath crimp portion 12B after the completion of crimping can have a further reduced plate thickness of the distal end 15*a* toward the end face side of the distal end 15*a* owing to the presence of tapered face $\mathbf{15}a_1$ on the outer wall face side, and both the tapered faces $\mathbf{15}a_1$ and $\mathbf{15}a_2$ can further reduce the volume of the water stop member-filled space in cooperation with each other. Consequently, the crimp terminal 1 of the present embodiment can further improve the filling efficiency of the water stop member 20 to the water stop member-filled space. Thus, the first to third areas that are connected to one another are easily to be formed, which can further improve the water stop property between the second barrel piece 16 and the sheath 52.

The volume of the water stop member-filled space on the end face side of the distal end 15*a* can be reduced by increasing the pressing amount of the second barrel piece 16 forming the wall face of the water stop member-filled space toward the sheath 52 side. Given this situation, in the second barrel piece 16 of the present embodiment, the plate thickness of the part forming the wall face of the water stop member-filled space is preferably made smaller than its surroundings. With this structure, a part of the second barrel piece 16 adjacent to the water stop member-filled space becomes easier to be deformed than the other parts of the second barrel piece 16 during the crimping processing. Consequently, the crimp terminal 1 of the present embodiment can increase the pressing amount toward the sheath 52 side during the crimping processing at the part forming the wall face of the water stop member-filled space of the second barrel piece 16, can thereby reduce the volume of the water stop member-filled space on the end face side of the distal end 15*a*, and can reduce the filling amount of the water stop member 20 in the water stop member-filled space. Consequently, the crimp terminal 1, through the crimping process, can easily fill the water stop member-filled space with the water stop member 20 and can thereby further improve the water stop property between the second barrel piece 16 and the sheath 52.

The second barrel piece 16 may provide a recess at a part (which may be on the outer wall face side or on the inner wall face side) forming the wall face of the water stop member-filled space, thereby reducing the plate thickness of the part compared with its surroundings, for example. In this example, a tapered face $\mathbf{16}a_2$ that reduces the plate thickness of the second barrel piece 16 toward its end face side may be provided on the inner wall face side of the second barrel piece 16 of the sheath crimp portion 12B in between the part forming the wall face of the water stop member-filled space and the end face of the distal end 16*a* (FIG. 9 and FIG. 13). In this case, the tapered distal end 15*a* and the tapered part of the second barrel piece 16 overlap each other after the completion of crimping. The crimp terminal 1 can provide an effect of reducing the volume of the water stop member-filled space on the end face side of the distal end 15*a* by the tapered distal end 15*a* and an effect of reducing the volume of the water stop member-filled space along with the increase in the pressing amount toward the sheath 52 side by the tapered part of the second barrel piece 16, enabling further reduction in the filling amount of the water stop member 20 in the water stop member-filled space. Therefore, the water stop member-filled space can be more easily filled with the water stop member 20 to improve the water stop property between the second barrel piece 16 and the sheath 52.

In the crimp terminal of the present embodiment, the volume of the space between the second barrel piece and the sheath on the end face side of the distal end of the first barrel piece is reduced, and thus the filling amount of the water stop member to the space is reduced. This configuration increases the filling efficiency of the water stop member in this space, and makes this space easy to be filled with the water stop member. Consequently, this crimp terminal can improve the water stop property between the second barrel piece and the sheath.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A crimp terminal comprising:

a terminal metal fitting including a terminal connecting portion to be electrically connected to a counterpart terminal, an electric wire connecting portion to be electrically connected to an end of an electric wire placed on an inner wall face side by crimping processing, and a coupling portion coupling the terminal connecting portion and the electric wire connecting portion, the electric wire connecting portion being sectioned into a bottom portion on which the end of the electric wire is placed during the crimping processing, an inner first barrel piece that is caused to extend from one end of the bottom portion to be wound around the end of the electric wire, and an outer second barrel piece that is caused to extend from another end of the bottom portion longer than the first barrel piece does and to be wound around the end of the electric wire and the first barrel piece, and the electric wire connecting portion being sectioned into a core wire crimp portion to be crimped onto a distal-end core wire of the electric wire, a sheath crimp portion to be crimped on a sheath of the electric wire, and a coupling crimp portion coupling the core wire crimp portion and the sheath crimp portion and to be crimped onto the end of the electric wire; and a water stop member that forms a first water stop area that is affixed to the inner wall face of the electric wire connecting portion before performing the crimping processing and suppresses entry of water from a gap between an outer wall face of the first barrel piece and the inner wall face of the second barrel piece to a gap between the electric wire connecting portion and the core wire after completion of the crimping processing, a second water stop area that suppresses entry of water from the terminal connecting portion side of a distal end position of the core wire to the gap between the electric wire connecting portion and the core wire, and a third water stop area that suppresses entry of water from a gap between the inner wall face of the sheath crimp portion and the sheath to the gap between the electric wire connecting portion and the core wire, wherein the inner wall face of a distal end in an extension direction of the first barrel piece of the sheath crimp portion includes a tapered face that reduces a plate thickness of the first barrel piece from the bottom portion side toward an end face side of the distal end, and a part of the third water stop area is connected among the end face side of the distal end of the first barrel piece, the inner wall face side, and the outer wall face side.

2. The crimp terminal according to claim 1, wherein the second barrel piece makes a plate thickness of a portion adjacent to a space between the second barrel piece and the sheath on the end face side of the distal end of the first barrel piece smaller than surroundings of the portion.

3. The crimp terminal according to claim 2, wherein the inner wall face side of the second barrel piece of the sheath crimp portion is provided with a tapered face that reduces the plate thickness of the second barrel piece toward an end face side of a distal end in an extension direction of the second barrel piece, in between the portion adjacent to the space and the end face.

* * * * *